US005490566A

United States Patent [19]

Purser

[11] Patent Number: 5,490,566

[45] Date of Patent: Feb. 13, 1996

[54] FIRE EXTINGUISHING PANELS

[75] Inventor: Robert W. Purser, Conyers, Ga.

[73] Assignee: FireMelt International, Inc., Conyers, Ga.

[21] Appl. No.: 104,432

[22] Filed: Aug. 9, 1993

[51] Int. Cl.[6] ..... A62C 35/10

[52] U.S. Cl. ..... 169/26; 169/57; 428/117; 428/920

[58] Field of Search ..... 169/26, 54, 56, 169/57; 428/117, 920

[56] References Cited

U.S. PATENT DOCUMENTS

| | | | |
|---|---|---|---|
| 1,169,210 | 1/1916 | Walsh | 169/57 |
| 1,369,179 | 2/1921 | Lee | 169/26 |
| 1,832,056 | 11/1931 | Spencer | 169/26 |
| 2,358,848 | 9/1944 | Carter | 169/57 |
| 2,522,020 | 9/1950 | Deyo | 169/58 |
| 2,786,537 | 3/1957 | Wainess | 169/26 |
| 2,857,971 | 10/1958 | Ferris | 169/26 |
| 2,876,845 | 3/1959 | Boyce | 169/26 |
| 2,917,116 | 12/1959 | Wyant | 169/57 |
| 3,040,815 | 6/1962 | Pambello | 169/57 |
| 3,171,493 | 3/1965 | Barr | 169/57 |
| 3,209,837 | 10/1965 | Freedman | 169/42 |
| 3,486,563 | 12/1969 | Cholin et al. | 169/26 |
| 3,654,996 | 4/1972 | Naglowsky | 169/57 |
| 3,710,855 | 1/1973 | Osorio | 169/26 |
| 3,782,475 | 1/1974 | Schmidt | 169/50 |
| 3,796,267 | 3/1974 | Hunter et al. | 169/57 |
| 3,918,526 | 11/1975 | Hattori et al. | 169/51 |
| 4,113,020 | 9/1978 | Panetta | 169/26 |
| 4,251,579 | 2/1981 | Lee et al. | 428/73 |
| 4,274,491 | 6/1981 | Tarpley, Jr. | 169/46 |
| 4,384,617 | 5/1983 | Mueller | 169/57 |
| 4,709,763 | 12/1987 | Jessick | 169/26 |
| 4,830,114 | 5/1989 | Jessick et al. | 169/26 |

OTHER PUBLICATIONS

ACC–P17B–8810, "DYTHERM Expandable Copolymers", Brochure, ARCO Chemical Co., Newton Square, Pennsylvania (1988).

*Primary Examiner*—Andrew C. Pike
*Attorney, Agent, or Firm*—Kilpatrick & Cody; James L. Ewing, IV; Scott T. Weingaertner

[57] ABSTRACT

Fire extinguishers include portions formed of heat fusible material that contain powderized fire extinguishing material. The heat fusible material releases the fire extinguishing material upon exposure to predetermined temperatures, and is preferably self-extinguishing. Such extinguishers may contain collection layers which collect the heat fusible material during a fire in order to minimize future gratuitous untidiness otherwise caused by coagulated heat fusible material on floors, furniture, and other surfaces. The extinguishers may conveniently be formed in panels which may supplant SHEETROCK® or ceiling panels, and thus escape notice of the casual observer. Similarly, a collar according to the present invention may be placed around the flue of a kitchen ventilator and effectively fight fire but remain out of sight. The extinguishers may also take the form of faux implements such as frying pans which may be hung on the wall, but which, when needed, serve effectively as fire extinguishers to release powderized material under the fires.

12 Claims, 5 Drawing Sheets

FIRE EXTINGUISHING PANELS

The present invention relates generally to fire extinguishers which contain powderized fire extinguishing material that may be released automatically when the extinguishers are exposed to a predetermined temperature.

BACKGROUND OF THE INVENTION

A large number of home and building fires could be prevented if stopped from proliferating during their early stages. For example, many kitchen grease fires proliferate when they are unattended, but could have been extinguished when they were contained within the cooking utensil. Similarly, fires in enclosed spaces such as offices are more effectively contained and extinguished when fire extinguishing material is applied immediately upon generation of significant heat.

A large array of liquid-, gas-, and powder-charged extinguishers, automatic sprinkler systems, and gas-charged systems are conventionally available for fire fighting purposes, and many of them are aimed at extinguishing fires early on in an automatic fashion. Frequently, however, such automatic systems are relatively expensive so that it is uncommon, for instance, to find a gas-charged system within the home cooking area, or sprinkler systems within the home. Apart from initial expense, automatic fire extinguishing systems of the gas- and liquid-charged types require periodic maintenance whose expense and administrative efforts are frequently beyond the means of home owners. Such follow-on requirements are not limited to homeowners, and impose burdens on commercial building owners.

It has been known to enclose a conventional powderized fire extinguishing material such as Purple K or ABC within expanded polystyrene foam or other container material which melts in the presence of heat. A primary disadvantage of many such systems, however, can be that the melted material coagulates on the floor or furniture below the extinguisher, and is accordingly difficult to clean. This is particularly the case when the melted container material mixes with the powderized fire extinguishing material.

Apart from the untidiness created by such earlier powderized systems, they have often been regarded as unsightly, such as in the form of panels which adhere to ceilings or walls. Such aesthetic problems may account, at least in part, for the less than overwhelming reception of these types of powderized systems by the public in the past.

SUMMARY OF THE INVENTION

The present invention provides powderized fire extinguishing material enclosed within new types of heat fusible containers, which melt upon exposure to a predetermined temperature in order to release the fire extinguishing material during the early stages of a fire. Among other things, such containers may be of self-extinguishing foam or polymeric material, which discontinue combustion when the ignition source is removed. Such containers may also include a collection layer such as a thin layer of material which does not melt at the same rate as the heat fusible layers, to which the heat fusible material may adhere as the powderized material is dispensed, in order to avoid otherwise inevitable cleaning and repair problems presented by coagulated heat fusible material on floors, furniture, and other surfaces.

Such containers may be in the form of panels which can be placed out of plain view in stove or oven ventilators. They may also conveniently be formed as faux ceiling members, such as panels for a drop-in ceiling or to supplant SHEETROCK® or other plasterboard as ceiling and/or wall surfaces. Such ceiling members may be useful in order to provide protection in non-sprinklered office buildings, for instance. The present invention thus contemplates such systems being unnoticed until and unless a fire occurs.

Extinguishers according to the present invention accordingly may function as ceiling or wall members to act as structural members or panels of a ceiling or wall, perform as fire extinguishers, provide significant insulation properties (such as, in one thick foam embodiment, a rating of up to 6 R's of insulation value), attenuate sound, resist moisture, and water stains, and/or avoid sagging properties inherent in SHEETROCK® or other plasterboard. Such members, when made of appropriate materials, resist bacteria or fungus growth, and avoid proliferation of harmful fibers which are characteristic of other types of structural members or insulation.

The containers of the present invention may also take the form of a collar which encircles portions of ventilator flues in kitchen and other areas. The extinguishing material is released around the flue where cracks and spaces often otherwise permit flames to pass and spread to surrounding areas.

Additionally, the present invention contemplates fire extinguishers which resemble, for instance, cooking pans, which are attractive in appearance, and which may be employed to cover a grease fire quickly and effectively. These implements may be used in addition to the panels mentioned above or separately.

It is accordingly an object of the present invention to provide automatic fire extinguishing containers of heat fusible material which contain powderized material that is released when the fusible material is exposed to a predetermined temperature.

Another object of the present invention is to provide automatic fire extinguishers which may be obtained inexpensively and which require minimum maintenance and thus are convenient and effective for household use in order to fight kitchen and structure fires.

Another object of the present invention is to provide fire extinguishers in the form of heat fusible panels outside of plain view, such as forming panels of drop in ceilings or SHEETROCK® or other plasterboard which may be textured, surfaced, and painted, but which provide effective fire extinguishing when needed.

Another object of the present invention is to provide inexpensive and effective fire extinguishing implements for those who find themselves fighting grease and stove top fires.

Other objects, features, and advantages of the present invention will become apparent with reference to the remainder of this document.

DETAILED DESCRIPTION OF THE DRAWINGS

Figure 1:
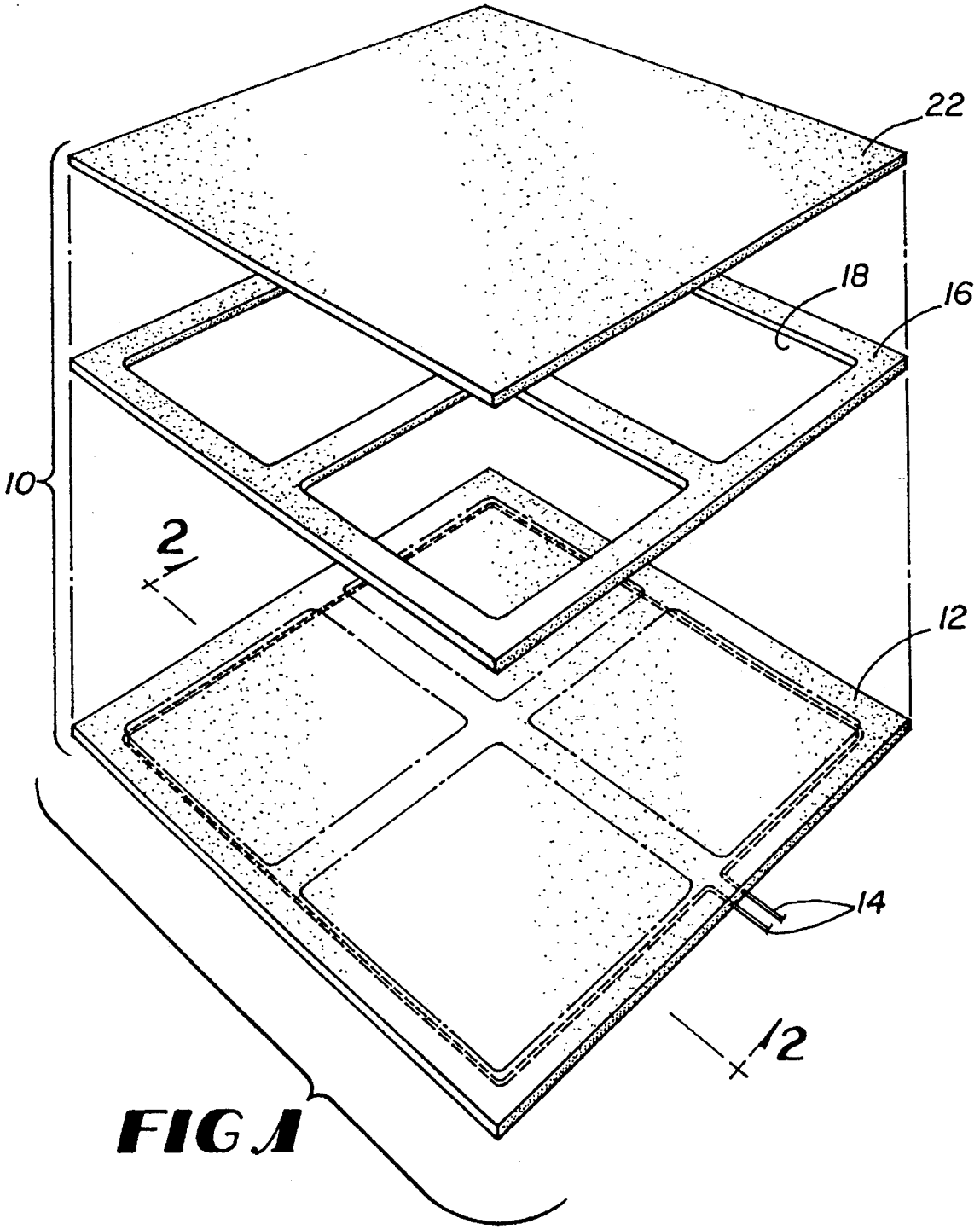
FIG. 1 is a perspective view of a first embodiment of a fire extinguishing panel according to the present invention.
Figure 2:
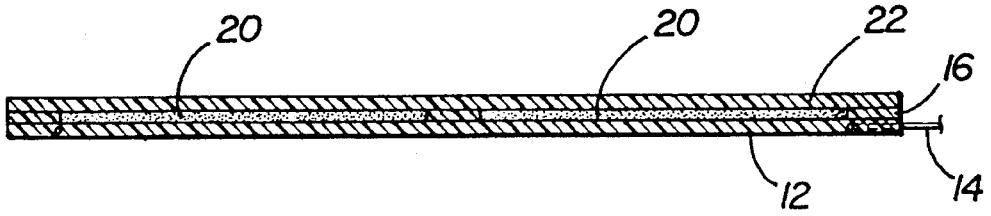
FIG. 2 is a side cross-sectional view of the panel of FIG. 1.

FIG. 1 shows a first embodiment of a fire extinguishing panel 10 according to present invention. Panel 10 comprises at least three laminations. A first or bottom lamination 12 is one of a heat fusible material such as, for instance, expanded polystyrene. Preferably, that material is of polymeric material such as expanded polystyrene.

The laminations may be molded, if desired, with various areas having various density. One surface, for instance, may feature a four pound per cubic foot density to withstand punctures, breakage, and other abuse more effectively, while the other surfaces are molded at a lower density, such as one and one-half pounds. Such differential density molding may also vary laterally over the surface of the panel, in applications such as where the panel is used as a diaphragm (as in mobile or modular home ceilings which must transfer pressure). Such techniques are referred to in the Housing and Urban Development Manufactured Homes Standard Program "Approved as Structural Ceiling Diaphragm" specifications.

Additionally, the laminations may include internal I beam or other members for additional structural enhancement if desired. Such strength members may just as easily be formed by the differential density molding techniques mentioned above, as for instance, molding longitudinal or lateral strength members (or both) at twenty pounds per cubic foot.

Even more preferably, the polymeric material is of the type which has been manufactured to be self extinguishing. One such material is marketed under the name DYTHERM® expanded copolymer, by Arco Chemical Company. Although such material may melt or burn in the presence of an ignition source, the material self-extinguishes after the source is removed. In any event, the melted material, if and when it burns, contributes in only minor fashion to the combustion at which extinguishers of the present invention are directed.

Lamination 12 may contain a conductor 14 to which electrical power may be supplied in order to fuse, and thus to penetrate or cut, first lamination 12 and dispense fire extinguishing material as discussed below. The thickness of lamination 12 (and of other laminations discussed below) may be as desired, in order, for instance, to allow the thickness of panel 10 to correspond to the thickness of SHEETROCK® or other conventional plasterboard material or ceiling panel material.

Second lamination 16, if present, is also formed of heat fusible polymeric material and contains at least one void 18 in which powderized extinguishing material 20 may be contained. Powderized material 20 may be conventional powderized fire extinguishing material such as, for instance, Purple K or ABC.

Figure 3:
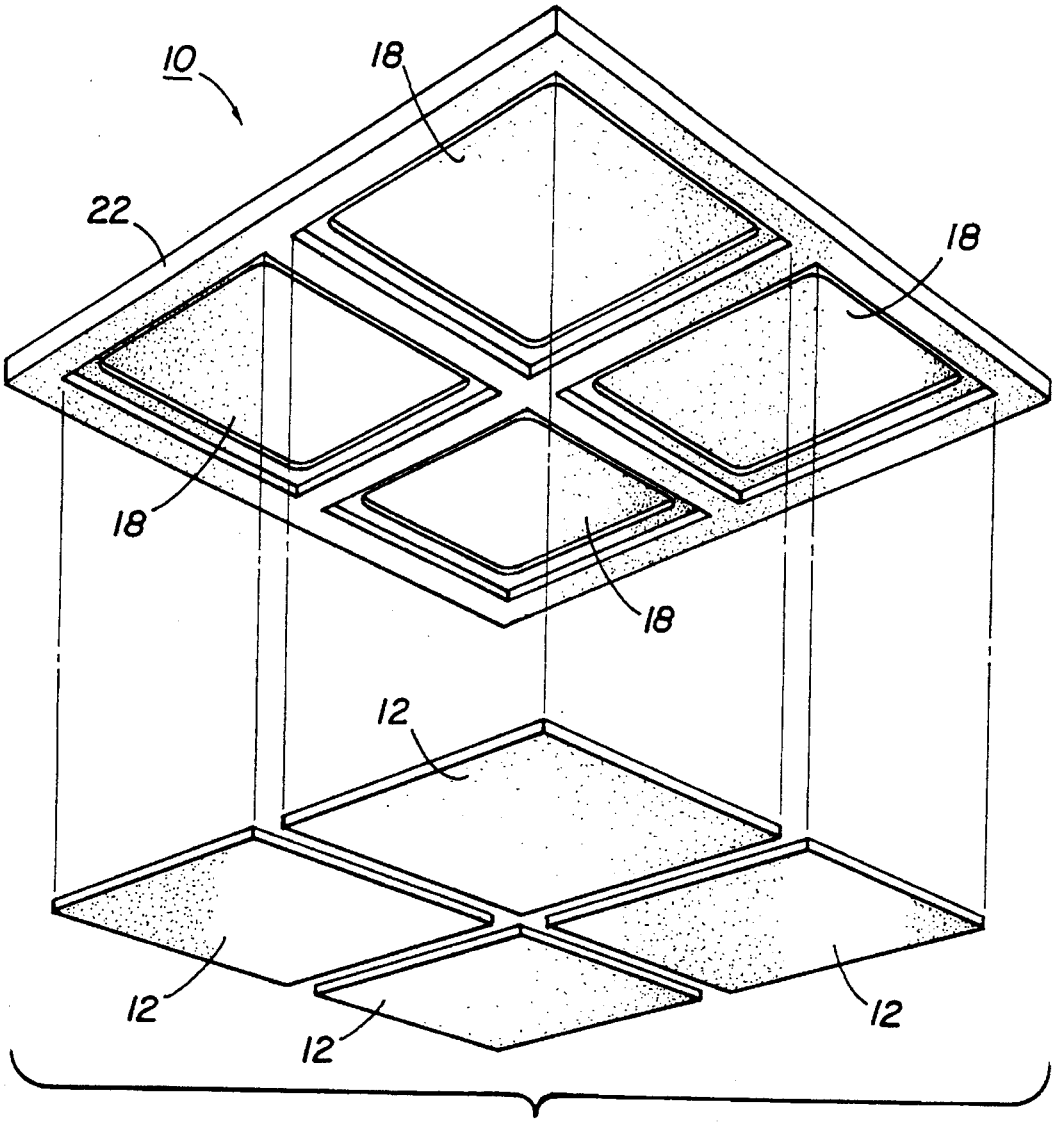
FIG. 3 is a perspective view of a second embodiment of a fire extinguishing panel according to the present invention.
Figure 4:
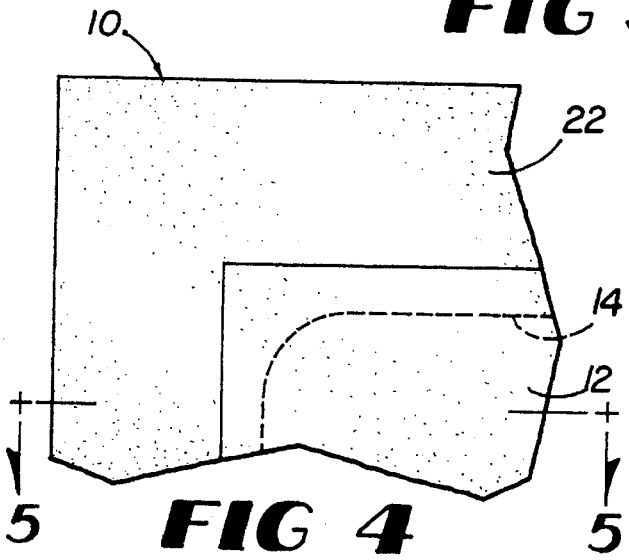
FIG. 4 is a plan view of a portion of the panel of FIG. 3.
Figure 5:
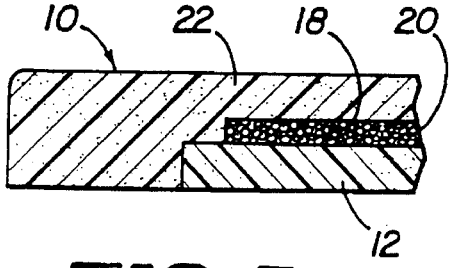
FIG. 5 is a cross-sectional view of a portion of the panel of FIG. 3 shown in FIG. 4, the cross-section taken through the section line 5—5.

Voids 18 may also be included in variations of panels according to the present invention which do not contain second lamination 16, as shown, for instance, in FIGS. 3–4. There, third lamination 22 (discussed below) contains voids 18 which contain fire extinguishing material 20. Just as easily, the voids 18 could be contained within first lamination 12, or any combination of laminations 12, 16, and/or 22.

Figure 6:
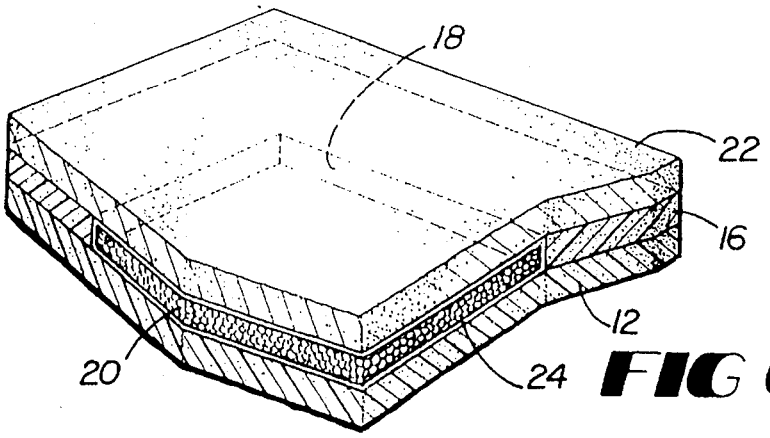
FIG. 6 is a perspective, partial cross-sectional view of a portion of the panel of FIG. 1.
Figure 7:
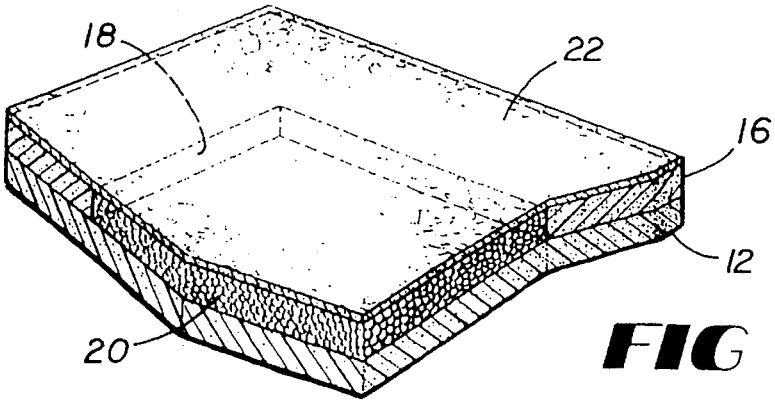
FIG. 7 is a perspective, partial cross-sectional view of a portion of a variation of the panel of FIG. 1.
Figure 8:
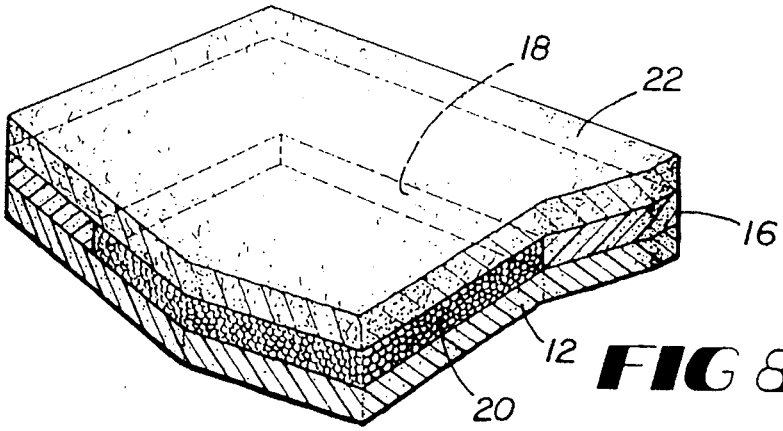
FIG. 8 is a perspective, partial cross-sectional view of a portion of another variation of the panel of FIG. 1.

A third or top lamination 22 is disposed above first lamination 12 or second lamination 16 and may form the top lamination of panel 10. Third or top lamination 22 may be of a heat fusible material such as the material of first or second laminations, as shown in FIG. 6. It may, however, be formed of a material such as a spun bonded material which permits flow of gasses through panel 10 during the fire, but which prevents flames from passing through. Such a structure is shown in FIG. 7. Alternatively, third lamination 22 may be formed of a material such as a plasterboard/fiberglass composite which provides excellent insulation properties and also prevents penetration of either flame or gasses during a fire. Such a structure is shown in FIG. 8.

Figure 9:
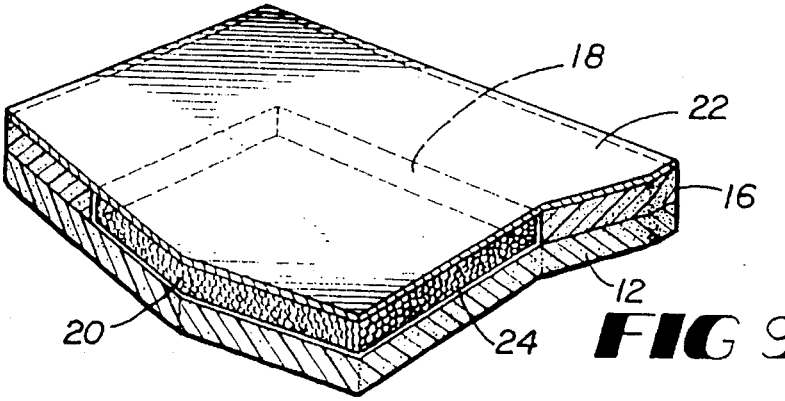
FIG. 9 is a perspective, partial cross-sectional view of a portion of yet another variation of the panel of FIG. 1.

FIG. 9, in similar fashion, shows a structure which includes an aluminum layer, such as 0.030 gauge aluminum sheet, as third lamination 22 in order to block passage of flames or gasses.

As shown more clearly in FIGS. 6 and 7, a collection layer 24 may be disposed in panel 10 such as, for instance, around powderized fire extinguishing material 20. It may also be sandwiched or disposed between entire laminations or portions thereof as desired. Collection layer 24 may, for instance, be interposed between the entirety of first and second laminations 12 and 16, second and third laminations 16 and 22, or both, first and third laminations 12 and 22, or underlie first lamination 12 or overlie third lamination 22 in appropriate cases. Collection layer 24 may be formed of latex or other materials, whether or not heat fusible. In any event, if the material fuses, it fuses at a higher temperature than heat fusible material forming laminations 12 or 16. The primary aim of collection layer 24 is to collect heat fusible material from the laminations as they fuse, in order to prevent such material from otherwise dripping into the space below and creating an untidy situation.

The structure of the third lamination 22 may allow panels 10 to address various structural requirements. For instance, panel 10 may include portions of third laminations 22 which are penetrable by either gas or flames, and other portions which are penetrable by gas, but not flames, or impenetrable by both. Consequently, such panels 10 may be placed in a structure in a predetermined fashion in order to allow gasses (and smoke) to escape in controlled fashion during a structure fire, in order to minimize smoke damage and control fires in a predetermined fashion.

Conveniently, the panel of FIG. 1 may be formed of the same thickness as SHEETROCK® or other conventional plasterboard material and used in its place. First lamination 12 may accordingly be adapted to receive conventional (or unconventional) texturing compound and/or paint as desired.

Alternatively, the panel 10 of FIG. 1 may be sized to supplant conventional ceiling panels in drop-in ceilings.

FIG. 3 shows the structure of a larger panel which may be sectioned as desired during manufacture, distribution, or end use into smaller ceiling panels or for other uses.

Figure 10:
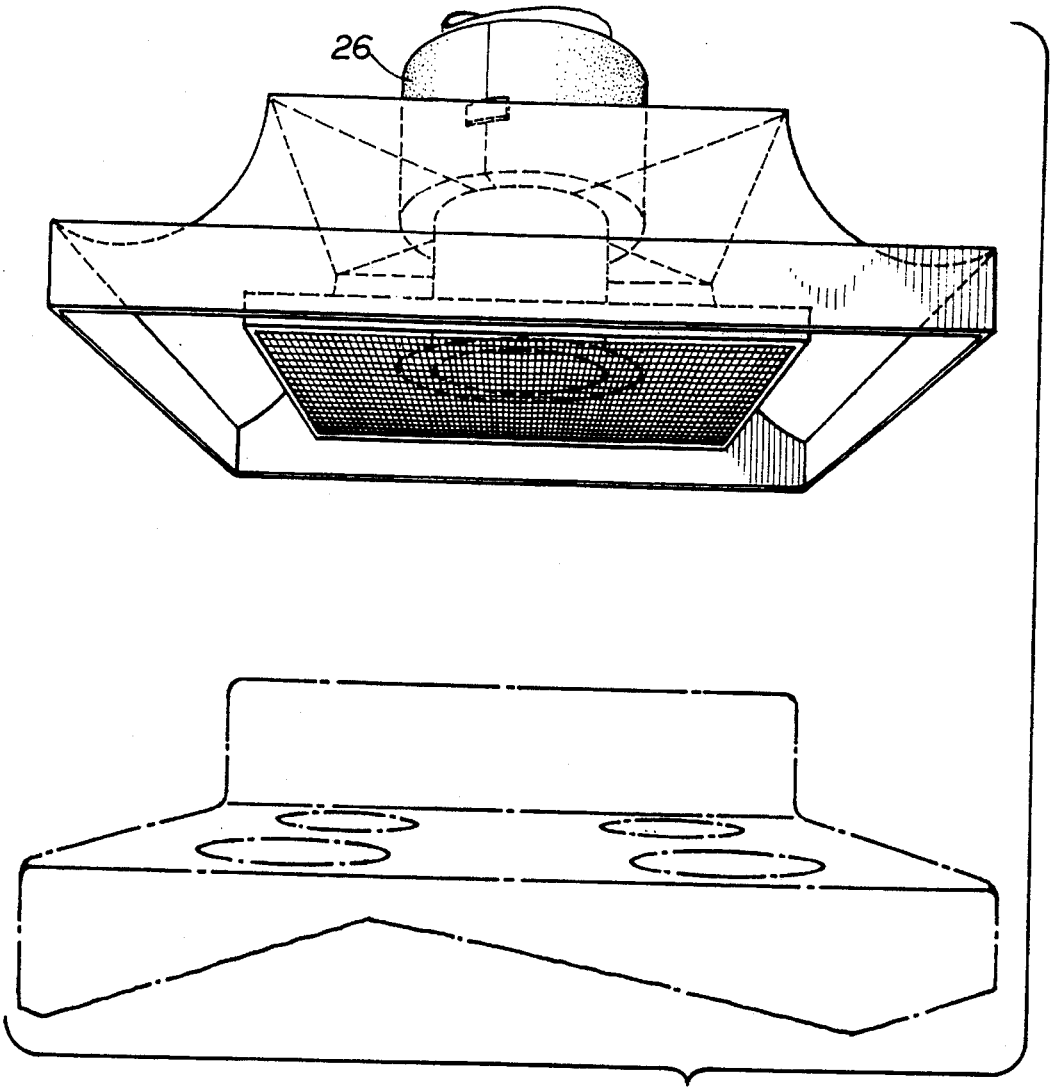
FIG. 10 is an embodiment of the present invention in the form of a collar which may encircle a ventilator hood.
Figure 11:
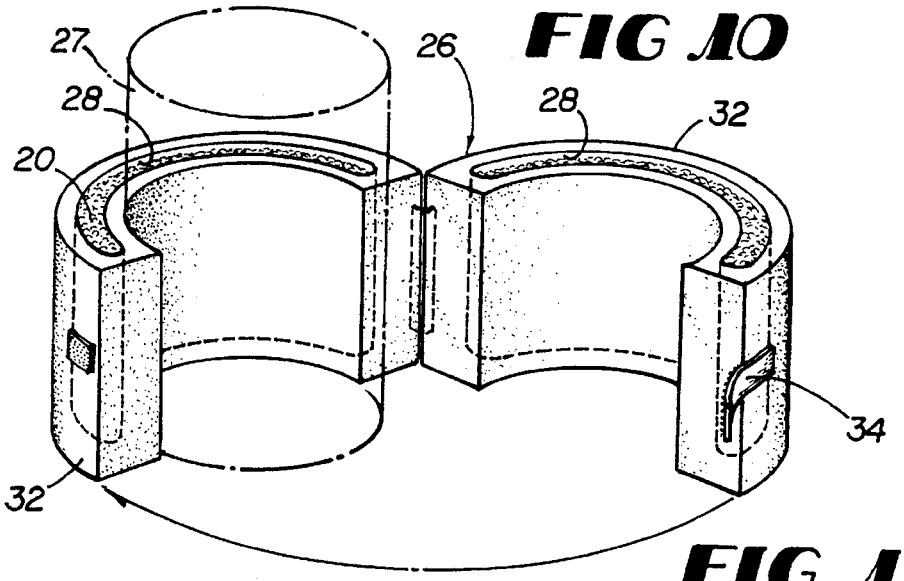
FIG. 11 is a more detailed view of the collar of FIG. 10.

FIG. 10 shows another embodiment of the present invention in the form of a collar which encircles the flue of a ventilator. Frequently, flues which exit ventilators and pass through cabinets or other household structures contain cracks or spaces through which flames may pass. Collars 26 according to the present invention are aimed at dispensing fire extinguishing material 20 into such spaces and preventing proliferation of the fire, if not extinguishing it. The collar 26 may be formed of heat fusible polymer material such as expanded polystyrene and be shaped in ring configuration as shown in FIG. 10. FIG. 11 shows one structure for creating the ring, in which an annular void 28 is contained within the heat fusible material of collar 26. The collar of FIG. 11 is shown as constituting two semicircular halves 32 which are attached by fasteners 34. Fewer or more sections may be used, as well as other fasteners, in order to place collar 26 around flue 27.

Figure 12:
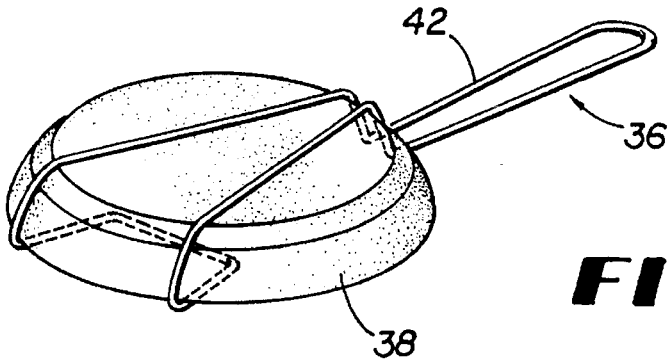
FIG. 12 is an embodiment of the present invention in the form of a simulated frying pan which may be utilized as a fire extinguisher.
Figure 13:
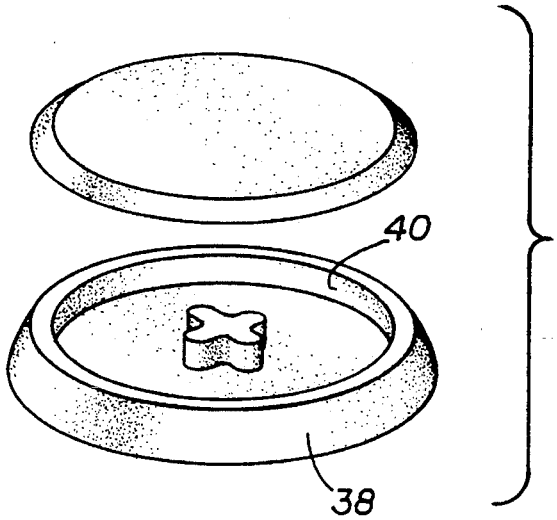
FIG. 13 is a view showing portions of the extinguisher of FIG. 12.
Figure 14:
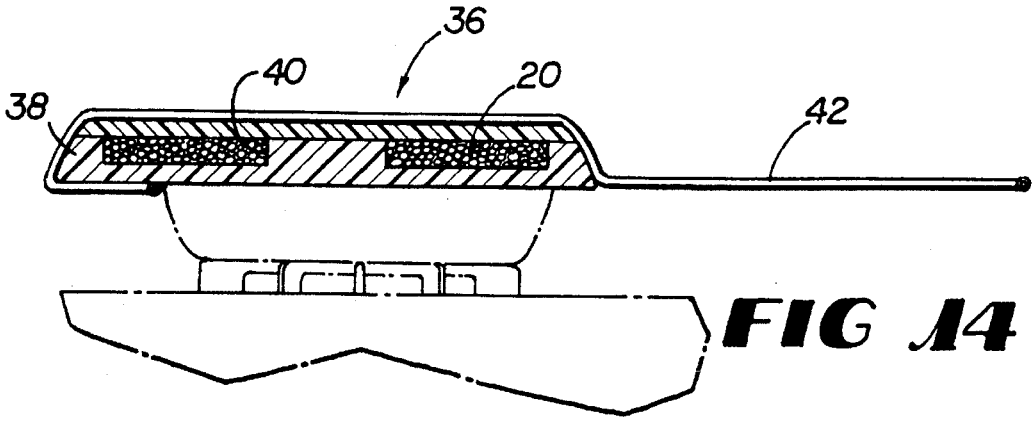
FIG. 14 is a cross-sectional view of the extinguisher of FIG. 12 placed on a stove top fire.

FIGS. 12–14 show another embodiment of the present invention in the form of a fire extinguisher that resembles a frying pan. The extinguisher may be hung near the stove and conveniently effectively used by those who confront stove top fires. Extinguisher 36 comprises generally a flat portion 38 which resembles generally the food containing portion of a cooking utensil. The flat portion 38 may be disk-shaped, and may be frustoconically disk-shaped in order to resemble a frying pan if desired, for instance. The flat portion contains a void 40 which in turn contains powderized fire extinguishing material 20. A handle 42 may be attached (in releasing fashion if desired) to hang extinguisher 36 on the wall and otherwise cause it more closely to resemble a cooking utensil.

The foregoing is provided for purposes of illustration of preferred embodiments of the present invention. Modifications may be made to the concepts and structures disclosed herein without departing from the scope or spirit of the invention.

What is claimed is:

1. A fire extinguishing panel comprising:

(a) a bottom lamination formed of heat fusible polymeric material and having a bottom surface;

(b) a top lamination adapted to constitute an uppermost interface between any fire below the panel and structure above the top lamination, the top lamination having a top surface;

(c) at least one void in the panel between the top surface of the top lamination and the bottom surface of the bottom lamination;

(d) a collection layer connected to at least one of the laminations for collecting fused portions of the laminations when the panel is exposed to a predetermined heat level; and (e) a fire extinguishing material disposed in the at least one void.

2. A panel according to claim 1 in which at least a portion of the top lamination suppresses penetration of flames.

3. A panel according to claim 2 in which the top lamination is formed of spunbonded material.

4. A panel according to claim 1 in which at least a portion of the top lamination suppresses penetration of flames and gasses.

5. A panel according to claim 4 in which the top lamination is formed of aluminum.

6. A panel according to claim 4 in which the top lamination is formed of plasterboard impregnated with fiberglass.

7. A panel according to claim 1 in which at least a portion of the top lamination is adapted to fuse upon exposure to a predetermined heat level and permit passage of flames and gasses.

8. A panel according to claim 1 in which the collection layer is formed of latex and is applied to at least a portion of the bottom lamination.

9. A panel according to claim 1 in which the bottom lamination contains a conductor which may be heated to a temperature exceeding the temperature at which the bottom lamination fuses, in order to cut the bottom lamination and release the fire extinguishing material.

10. A panel according to claim 1 in which the fire extinguishing material is powderized.

11. A fire extinguishing panel comprising:

(a) a first lamination formed of expanded, heat fusible self-extinguishing polymeric material;

(b) a second lamination connected to the first lamination, wherein said second lamination is formed of expanded, heat fusible polymeric material;

(c) a third lamination connected to the second lamination, wherein said third lamination is formed of material that suppresses passage of flames;

(d) at least one void in the second lamination and between the first and third laminations of the panel; and (e) a fire extinguishing material disposed in the at least one void.

12. A fire extinguishing panel according to claim 11 further comprising a collection layer, connected to at least one of the laminations for collecting fused portions of the laminations when the panel is exposed to a predetermined heat level.

* * * * *